US009764933B2

(12) United States Patent
Knapp et al.

(10) Patent No.: US 9,764,933 B2
(45) **Date of Patent: *Sep. 19, 2017**

(54) MACHINERY POSITIONING APPARATUS HAVING INDEPENDENT DRIVE COLUMNS

(71) Applicants: Ryan W. Knapp, Sandy Hook, CT (US); Peter McGonagle, Southport, CT (US); Mark O'Donnell, Danbury, CT (US)

(72) Inventors: Ryan W. Knapp, Sandy Hook, CT (US); Peter McGonagle, Southport, CT (US); Mark O'Donnell, Danbury, CT (US)

(73) Assignee: Macton Corporation, Oxford, CT (US)

( * ) Notice: Subject to any disclaimer, the term of this patent is extended or adjusted under 35 U.S.C. 154(b) by 559 days.

This patent is subject to a terminal disclaimer.

(21) Appl. No.: 14/104,890

(22) Filed: Dec. 12, 2013

(65) Prior Publication Data

US 2015/0166313 A1 Jun. 18, 2015

(51) Int. Cl.

| | |
|---|---|
| ***B66F 7/12*** | (2006.01) |
| ***B66F 7/02*** | (2006.01) |
| ***B66F 11/04*** | (2006.01) |
| ***B66F 7/10*** | (2006.01) |
| ***B66F 11/00*** | (2006.01) |

(52) U.S. Cl.

CPC ..... *B66F 7/025* (2013.01); *B66F 7/10* (2013.01); *B66F 11/00* (2013.01); *B66F 11/04* (2013.01); *B66F 7/02* (2013.01)

(58) Field of Classification Search

USPC ..... 254/89 R

See application file for complete search history.

(56) References Cited

U.S. PATENT DOCUMENTS

| | | | | |
|---|---|---|---|---|
| 1,136,934 A * | 4/1915 | Camp | B66F 3/24 | 187/210 |
| 1,541,527 A * | 6/1925 | Powell | B65G 7/12 | 414/564 |
| 1,710,552 A * | 4/1929 | Rood | B66F 7/02 | 187/209 |

(Continued)

FOREIGN PATENT DOCUMENTS

| | | |
|---|---|---|
| CN | 1903698 B | 7/2011 |
| DE | 19709526 A1 | 7/1998 |
| IT | GB 1200047 A * | 7/1970 |

*Primary Examiner* — Larry E Waggle, Jr.
*Assistant Examiner* — Alvin Grant
(74) *Attorney, Agent, or Firm* — St. Onge Steward Johnston & Reens, LLC

(57) ABSTRACT

Provided is a system and method for positioning a load including an apparatus having a plurality of columns. Each column has a first support and a motor adapted to move the first support along an axis of the column. A second support is connected to at least two of the first supports and a track member for receiving a portion of a vehicle is connected to the second support. Load and position sensors are coupled to the apparatus for transmitting load and position signals. A controller is in communication with the columns and receives the load and position signals to compare the load and position signals to generate at least one control signal that is sent to at least one of said motors for controlling the position of at least one of said first supports.

23 Claims, 15 Drawing Sheets

(56) References Cited

U.S. PATENT DOCUMENTS 1,772,858 A * 8/1930 Coffey ..... B60S 13/02 104/44
1,993,245 A * 3/1935 Meron ..... B60P 1/02 187/204
2,091,156 A * 8/1937 Myers ..... B66F 7/025 187/209
2,120,042 A * 6/1938 Remde ..... B66F 9/06 180/21
2,523,662 A * 9/1950 Miller ..... G03B 15/08 104/296
2,538,517 A * 1/1951 Hayden ..... B66F 7/04 187/212
2,909,298 A * 10/1959 Baudhuin ..... B66C 19/005 180/433
2,958,508 A 11/1960 Martinez
3,055,517 A * 9/1962 Kirkland ..... E04H 6/245 414/249
3,291,260 A * 12/1966 Woor ..... B66F 7/025 187/209
3,506,559 A 4/1970 Bonga
3,568,785 A * 3/1971 Gray ..... B60L 9/00 180/20
3,836,031 A * 9/1974 Weisker ..... B66F 9/072 414/668
3,881,426 A * 5/1975 Long ..... B61C 9/38 104/45
3,972,434 A * 8/1976 Mecklenburg ..... B66F 9/06 414/495
4,444,287 A * 4/1984 Voelz ..... B66C 19/007 180/252
4,557,355 A 12/1985 Wilke et al.
4,715,477 A * 12/1987 Suzuki ..... B66F 7/02 187/210
4,732,186 A * 3/1988 Nishikawa ..... B60S 3/04 134/123
4,984,657 A * 1/1991 Burns ..... B66F 7/025 187/207
4,995,774 A * 2/1991 Nusbaum ..... B62D 7/026 180/234
5,086,704 A * 2/1992 Mueller ..... E04H 6/40 104/36
5,271,706 A * 12/1993 Helbach ..... B65G 51/03 198/746
5,343,581 A 9/1994 Bartley et al.
5,400,550 A * 3/1995 Beasley ..... E04B 1/346 104/35
5,518,220 A 5/1996 Bertrand et al.
5,547,038 A * 8/1996 Madwed ..... B60K 7/0007 180/253
5,755,160 A * 5/1998 Blufordcraving ..... B60S 13/02 104/36
6,382,106 B1 * 5/2002 Knight ..... B60S 13/02 104/35
6,471,009 B1 * 10/2002 Mabry ..... B66F 7/20 187/218
6,923,599 B2 8/2005 Kelso
7,163,088 B2 * 1/2007 Jahns ..... B60L 11/18 180/210
7,219,770 B2 * 5/2007 Baker ..... B66F 3/46 187/210
7,308,971 B2 * 12/2007 Liebetreu ..... B66F 7/28 187/203
7,461,733 B2 * 12/2008 Dohi ..... B62D 65/18 198/345.1
7,500,816 B2 * 3/2009 Berends ..... B66F 3/46 187/210
7,603,734 B2 10/2009 Connelly et al.
7,798,067 B2 9/2010 Starnes
7,815,017 B2 * 10/2010 Robbin ..... B65G 35/06 187/203
7,900,732 B2 * 3/2011 Brown ..... B66F 9/105 180/210
7,954,602 B2 * 6/2011 Stanislao ..... B66B 9/083 187/200
7,966,939 B2 6/2011 Holt
8,028,973 B2 * 10/2011 Ford ..... B66F 3/44 187/203
8,083,034 B2 * 12/2011 Bordwell ..... B66F 3/46 187/210
8,567,761 B2 * 10/2013 De Jong ..... B66F 3/46 254/134
8,919,476 B2 * 12/2014 Holland ..... B62D 1/00 180/167
9,238,477 B2 * 1/2016 Ahern ..... B62D 5/0457
9,267,258 B2 * 2/2016 Knapp ..... E02D 27/44
2006/0158043 A1 * 7/2006 Brouwer ..... B63B 25/22 307/149
2006/0230973 A1 * 10/2006 Nebeker ..... B60S 13/02 104/35
2007/0175353 A1 8/2007 Jeffs
2009/0145326 A1 6/2009 Esposti et al.
2009/0242333 A1 * 10/2009 Finkbeiner ..... B66F 7/20 187/209
2010/0066278 A1 * 3/2010 De Jong ..... B66F 7/16 318/376
2012/0043159 A1 * 2/2012 Clark ..... B62D 7/1509 182/69.6
2013/0240300 A1 * 9/2013 Fagan ..... B66F 3/46 187/210

* cited by examiner

MACHINERY POSITIONING APPARATUS HAVING INDEPENDENT DRIVE COLUMNS

FIELD OF THE INVENTION

The following invention relates to a lifting and positioning apparatus. More particularly, the following relates to lifting machinery for rail car and engine maintenance.

BACKGROUND OF THE INVENTION

In many factories and repair shops, lifting and positioning equipment is used to move heavy objects or to remove parts to expose the underside of the vehicle or to provide easier access for repair and/or replacement of parts and assemblies. This allows a worker to inspect, repair or assemble various items with greater ease than when attempting to work through gaps or crawl spaces.

U.S. Pat. No. 7,603,734 to Connelly et al discloses a system for lifting a passenger boarding bridge for an aircraft that avoids rack fault. The system has two electromechanical screw jacks. Each motor receives a signal for adjusting the height of the tunnel selection and the system uses rotational sensors to monitor the position of the two screw jacks. Connelly does not appear to disclose a controller that monitors multiple sensors from each column to determine the position and load on the screw jacks to calculate a control signal for each of the columns.

One difficulty encountered with rotational sensors is that they can become out of phase by missing a rotation count. For example, the rotational sensor may count each rotation based on passing a optic or magnetic sensor. In many cases, some of the rotations may not be properly counted, which could lead to one column bearing a higher percentage of the overall load. Further, if the rotational sensor does not count rotations correctly, rack fault could occur.

U.S. Pat. No. 6,923,599 to Kelso discloses an in-ground lifting system for raising a building foundation. Kelso appears to show columns placed below the foundation of a building. Kelso also appears to disclose the ability to monitor the position through sensors to minimize stresses on the foundation. It does not appear that a control program monitors multiple types of sensors from each column to determine the position and/or load in order to calculate a control signal.

It is therefore desired to provide a lifting and positioning apparatus that overcomes the disadvantages of the prior art.

Vehicles such as busses, cars and rail vehicles may not provide enough space between the ground and the underside of the vehicle for access to parts or assemblies that require inspection and repair. These vehicles are often rather heavy, and lifting the vehicle or positioning various parts of the vehicle requires precise balancing and positioning of the various items. Also, the machinery used to lift or position these items undergoes a great deal of wear, and thus the maintenance and proper function of the lifting equipment itself is critical for safety concerns.

Various car hoist or drop table systems are known in the art. These systems have more than one lifting column connected to a single motor, where the rotation of the motor causes translation of a support on the column through a transmission system. The transmission system can be used to adjust the gearing to likewise adjust the speed of the support that moves along the column. For example, FIGS. 6 and 7 show a positioning apparatus having a motor 1 that is connected to transmission columns 3, 5, 7, 9. These transmission columns are connected to the motor via a drive shaft. As shown in FIG. 7, a track section 11 is connected to the transmission columns. The motor rotates the drive shaft to transmit a rotational force to each of the transmission columns 3,5,7,9. These transmission columns have a gearing system that adjusts the rotation of the screw 13, 15, 17, 19. As discussed previously, the load on the columns is often rather high, which can result in increased wear. Failure of gears within the transmission column can result in serious safety issues if failure occurs after a heavy load has been lifted above the floor.

Further, the replacement and maintenance of the transmission columns can be a skill and labor intensive process that may require specialized individuals who have been trained to repair a particular machine. The scheduling of the repair personnel can often result in a shutdown of a given machine in a way that can create bottlenecks in the repair shop or factory.

In some cases, the positioning device is designed to lift the entire vehicle for inspection and repair of the underside of the vehicle. In some cases, the positioning device is designed to be placed under a specific part or assembly of the vehicle, where the part or assembly is dropped down from the vehicle.

As an example, a rail car such as a locomotive can be rather heavy. It may be more efficient and safer to bring a wheel and axle assembly down from the engine rather than lifting the entire engine. In some cases, however, it is more appropriate to lift the entire rail car or locomotive. In other cases, the repair may only necessitate lifting a part or assembly of the rail car, for example a wheel assembly. The lifting apparatus used depends on the repair or assembly job to be completed.

The precision of the lifting process is important to balance the load and to ensure correct positioning of the columns and correct positioning of the rail car, locomotive or part or assembly thereof. The present systems and methods provide a more user friendly lifting and positioning apparatus which can likewise can aid to provide a safer working environment and reduce repair and maintenance costs.

As a further aid to safety and reliability, the position control can reduce un-necessary damage to the apparatus. Since of the mass of the item to be lifted may be relatively large, the columns can generate substantial torques and forces. If the position of the individual columns is not controlled properly, one or more of the columns could come out of alignment and bend the support structure that is connected to the columns. Thus, the failure to properly control the columns can result in damage to the structure of the lifting apparatus itself.

SUMMARY OF THE INVENTION

It is therefore an object of the present invention to provide a lifting and positioning apparatus that allows for more accurate and precise positioning and load balancing. It is yet another object of the present invention to provide a lifting and positioning apparatus which can allow for easier repair and replacement of critical wear intensive parts and assemblies. It is still another object of the invention to provide a lifting and positioning apparatus that operates with increased safety and reliability. Yet another object of the invention is to provide a lifting and positioning apparatus that avoids damage to the support structure due to incorrect positioning. The damage avoided could be due to, for example, bending and warping as well as cyclical and plastic deformations and/or failures.

Because the columns may be interchangeable, the bottom flange may simply be un-bolted from the base, the second support and the first support of the column to be replaced could be dis-connected and the electrical connections dis-connected. This allows for one column to be removed with limited repair skill or specialized mechanical knowledge. In comparison to the prior art, this saves a great deal of time. The prior art systems included geared transmissions that were coupled to a motor, where adjustment of the gear ratio would change the speed of the lift. Since each column has its own motor and sensors in a self-contained package, it is much easier to replace columns and critical wear parts with minimal machinery downtime.

Therefore, the above mentioned and other objects are achieved by providing a vehicle positioning apparatus having a plurality of columns, each column having a first support and a motor for moving the first support along an axis of the column. A second support is connected to at least two of the first supports. A track member is connected to the second support, the track member may be for receiving at least a portion of a vehicle. At least one load sensor transmits a load signal indicative of a load on of the plurality of columns. At least one position sensor transmits a position signal indicative of a position of the first supports. A controller is in communication with the plurality of columns and receives the load and position signals. The controller compares the load and position signals to generate at least one control signal, which is sent to at least one of the motors for controlling the position of at least one of said first supports. Depending on the control input or which column needs to be adjusted to level the second support, a control signal may also be generated for each of the columns that are to move.

The positioning apparatus may include at least one load sensor connected to each of the plurality of columns and at least one position sensor connected to each of the first supports. The load sensor may be an electrical load sensor where the load signal is indicative of an electrical current of the motor. The apparatus may include four columns and also include at least one limit switch connected to at least one of the plurality of columns at a bottom or top end. Each limit switch has a first position and a second position, where each limit switch is adapted to move from the first to the second position when one of the first supports is in a position associated with the limit switch. When one of the limit switches is in a second position, movement, of the first support corresponding to the column having the limit switch in the second position, may stop.

The apparatus may further include a third limit switch having first and second positions. The third limit switch coupled to at least one of the columns and disposed between the first and second limit switches, the third limit switch in communication with the controller, where the control input is indicative of a position associated with the third limit switch. The controller can calculate a control signal from the position signal, load signal and control input to move the first support to the position associated with the third limit switch. Movement of at least one of the first supports may stop when the third limit switch is in the second position.

Each column of the apparatus may include first, second and third limit switches. The position sensor may be a linear position sensor coupled to the first support member. The position signal may be indicative of a position of said first support member in relation to a fixed point. The apparatus may include first and second limit switch coupled to at least one of the plurality of columns. The first and second limit switches may be respectively positioned at top and bottom ends of the column, each limit switch having first and second positions. The motor may be adapted to stop once one of the top or the bottom limit switches is in the second position, where the second position of one of the top and bottom limit switches indicates that the first support has reached the position associated with the top or the bottom limit switch.

The apparatus may include a control input received by the controller and indicative of a direction of movement for the second support. The controller may calculate a load distribution among the first supports to generate a calibration for the controller. The controller may maintain the load distribution during movement of the second support. The load distribution may also be maintained within a range of loads. The range may be predetermined, set by the operator or another user, calculated based on the amount of load on the second support or be within a percentage range. Other scenarios for the range as would be apparent to one of skill in the art are contemplated and these examples are not limiting.

Other objects are achieved by providing a controller for a positioning apparatus having a processor and an input module associated with the processor for receiving a control input indicative of a position for the positioning apparatus. A sensor module may be associated with the processor for receiving a plurality of sensor signals from each of a plurality of positioning columns, the plurality of columns each having a first support and a motor for moving the first support along an axis of the column. A position module may be associated with the processor for calculating a position of each of the first supports from at least a first one of the sensor signals. A load module may be associated with the processor for calculating a load on each of the columns from at least a second one of the sensor signals. A control signal module may be associated with the processor for comparing the positions of each first support, the loads on each of the columns and the control input to generate a control signal. The controller may transmit the control signal to at least one of the motors to control the position of at least one of the first supports.

The controller may include a calibration module for calculating a load distribution among the plurality of columns to generate a calibration for the controller. The control signal module may maintain the load distribution within a range during movement of at least one of the first supports. The controller may include a limit switch module adapted to receive a signal indicative of a limit switch position of at least one limit switch, the limit switch connected to at least one of the plurality of columns. The limit switch position may be indicative of at least one of the first supports in a position corresponding to a first limit switch. The control signal module may generate a control signal to stop movement of the first support associated with the column having the first limit switch connected thereto.

Other objects are achieved by providing a positioning column having bottom and top ends, the positioning column for a positioning apparatus and including a first support and a motor. The motor moves the first support along an axis of the column and the first support is adapted to connect to a second support. The second support may receive at least a portion of a vehicle. A flange may be arranged at the bottom end of the column and adapted to releasably secure to a base of the positioning apparatus. At least two sensors may be coupled to the column to transmit a signal to a controller. The controller having a processor with a control program executing thereon. The motor may receive a control signal from the controller for changing the position of the first support in response to the control signal. The control signal may be calculated by the controller in response to the signal received from said at least two sensors. The motor and electrical connections may be compatible and interchangeable with the controller to allow for easier maintenance.

At least one limit switch may be connected to the column at a bottom or top end, the limit switch having a first position and a second position. Each limit switch may indicate a first and second position and be adapted to indicate the second position when one of the first supports is in a position associated with the limit switch. One of the two sensors may be an electrical load sensor and the load signal may be indicative of an electrical current of the motor. Another one of the sensors may be a position sensor.

Other objects are achieved by providing methods including the steps of providing a positioning apparatus having a plurality of columns, each column having a motor adapted to move a first support along an axis of the column. Also provided is a second support connected to the first support. A controller is provided and in communication with each of the motors. The method may include receiving at least two sensor signals via the controller, a first one of the sensor signals indicative of a load on the positioning apparatus, a second one of the sensor signals indicative of a position of the second support. The method may include generating a control signal via the controller, the control signal generated from the two sensor signals. The method may further include transmitting the control signal to at least one of the motors to control the position of at least one of the first supports.

The method may also include receiving a control input indicative of a movement direction of the second support and generating a load distribution indicative of calculating a percentage of load on each column upon receiving the control input. The method may also include generating a control signal in response to the control input wherein the control signal maintains the load distribution within a range.

The method may also include receiving a limit switch signal from a limit switch connected to at least a first one of the columns, the limit switch signal indicative of a position of the first support. The method further may include preventing movement of at least one of the first supports when the position of the limit switch indicates that the first support of the first one of the columns is in a position associated with the limit switch. The controller may further include a processor with a control program executing thereon, the control program generating the control signal.

The term "rail car" as used herein includes but is not limited to locomotives, freight cars, box cars, rail cars, repair vehicles, push cars, and other vehicles that have wheels and can move on rails whether indoors or outdoors. This may include, for example, vehicles that can move on rails in a factory floor. The term "vehicle" includes but is not limited to "rail cars" as well as other powered and un-powered vehicles such as automobiles, cars, trucks, and military and construction vehicles such as tanks, excavators and construction equipment.

DETAILED DESCRIPTION OF THE INVENTION

Figure 1:
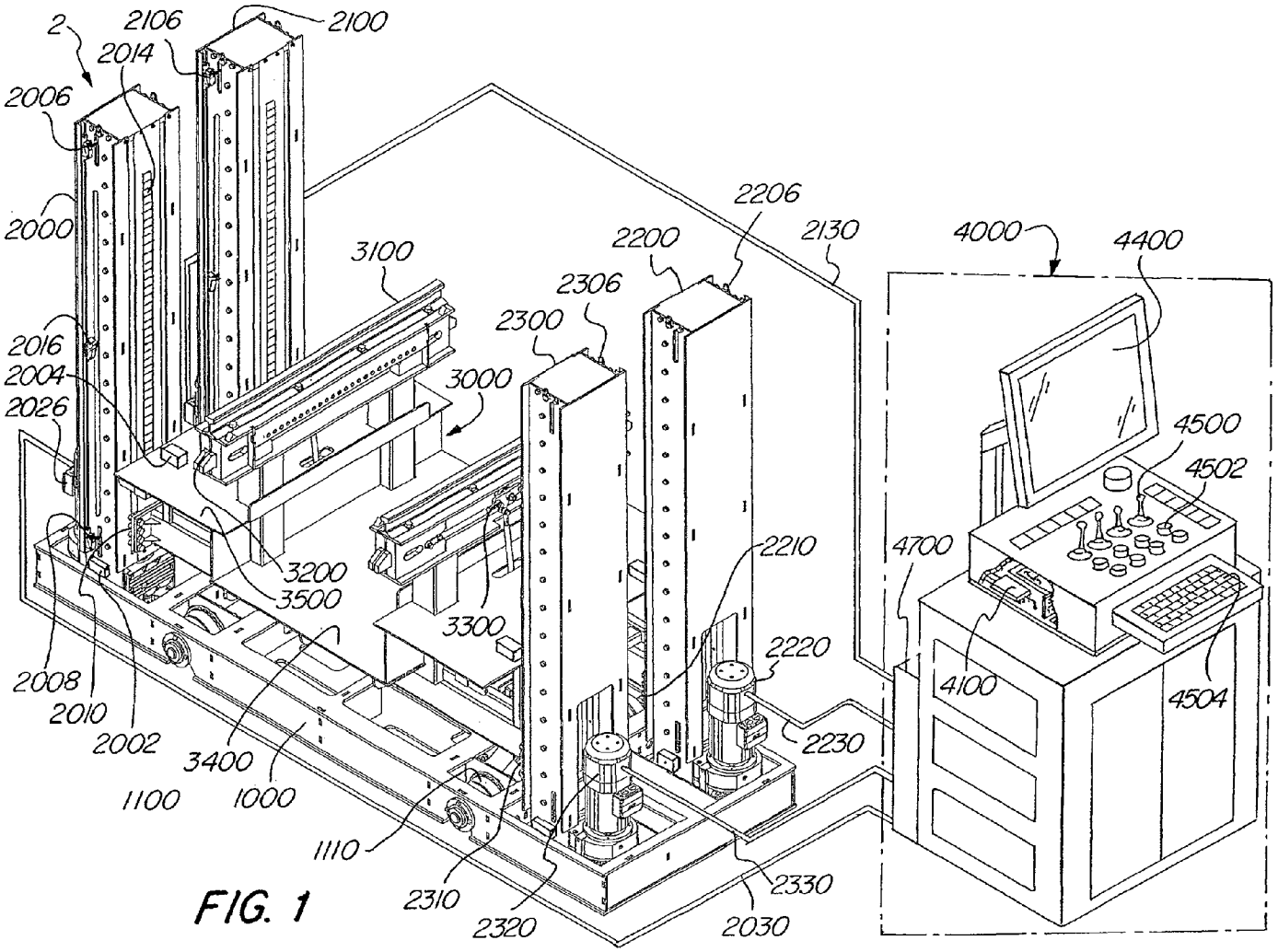
FIG. 1 is a perspective view of a lifting and positioning apparatus.

FIG. 1 shows a lifting and positioning device 2 having four columns 2000,2100,2200,2300. Each column includes a motor 2020,2120,2220,2320 that rotates a screw (not shown) to move a first support 2010,2110,2210,2310 up and down based on signals received from a controller 4000. The columns are affixed to a base 1000 that may have wheels 1100, 1110 to move the positioning apparatus. It is understood that although the wheels are shown as being adapted to run on rails, wheels that move on other surfaces can be provided. One or both sets of wheels 1100, 1110 can be powered, for example by a motor. In addition, where desirable, one or both sets of the wheels can be adapted to turn to steer the positioning apparatus 2. As shown, wires 2030, 2130,2230, 2330 connect the motors to the controller 4000. It is also understood that the wires may be designed to connect to a power source, and the controller could communicate with the individual motors through a wireless connection. Although shown with four columns, there could be more or less columns used, depending on the application. For example, two columns may be appropriate in certain circumstances, with one column on each end of the second support that is connected to the two columns. Further, the apparatus shown in FIG. 1 may be modified to include one column at each corner of the second support and then columns between, for example columns 2000 and 2300 and columns 2100 and 2200. It is also contemplated that columns can be placed between the corners to allow for longer track sections. In this case, the width of the base 1000 would be wider and thus the distance between columns 2000 and 2100 would likewise be larger. An additional column between columns 2000 and 2100 may provide added rigidity when the item to be lifted is longer, larger and thus heavier.

As shown, the controller is separate from the base 1000. It is understood that the base may be designed to have a location for the controller to affix thereto so that when the base rolls along the wheels 1100, 1110, the controller moves with the base. The wires or connections 2030,2130,2230, 2330 can have removable connections that allow for a stationary controller to work with columns and supports that are moved into place and then connected to the controller 4000 so that the second support 3000 can be moved up and down in response to a control input. The columns could be interchangeable with the controller to allow for easier maintenance and repair.

The second support 3000 can include more than one level, for example levels 3500 and 3400. The upper level 3500 has track sections 3100 extending therefrom. The bottom level 3400 can be used as a platform that allows workers to stand below the rail car part that will be worked on. For example, a rail car wheel assembly may be placed on the track sections 3100 for maintenance and repair. The bottom level 3400 would allow for maintenance workers to replace and repair the wheel assembly and replace or grease various parts. Likewise, the top level 3500 could allow access to different areas of the rail car part. As an example, the lifting and positioning apparatus shown may be what is referred to as a drop table. The drop table may be designed to interlock with a main rail system in an upper position where catches 3200 extend into a corresponding recess adjacent to a gap in the main track to lock the support 3000 in place. The rail car is then placed on the rail, with the wheel assembly to be repaired resting on track section 3100. The wheel section is released from the rail car and the catches 3200 are likewise released. A link mechanism 3300 is rotated to extend and retract the catches 3200. The motors are then operated by the controller 4000 to move the first supports 2010,2110,2210, 2310 down to a level where a worker accesses the bottom level 3400 of the second support 3000.

Once the wheel assembly is lowered and removed, the base 1000 may be moved along a secondary track or simply moved out of the way. Then a second positioning apparatus would be moved into place below the main track and a replacement wheel assembly could be lifted up to the vehicle. The catches 3200 would extend to lock the track section 3100 in place and the wheel assembly would then be affixed to the vehicle. The old wheel assembly, now on the first positioning apparatus can be repaired on the positioning apparatus, or may alternately be moved to other locations in the factory or repair shop where repair can take place.

A number of sensors may be fitted to the positioning apparatus 2. Position sensor 2004 may read indicator strip 2014 using a laser or other optical device. Alternately a sensor interface 2028 may include a rotational encoder that counts the revolutions of the motor to determine the position of the first support 2010. Further, limit switches 2006, 2008 may be used to designate a stopping position for the second support 3000 at an end of the column. An intermediate limit switch 2016 may be placed between the ends of the column to designate a pre-determined position for the system. These intermediate switches may be adjustable to allow for the pre-set positions to be later modified. Although one intermediate switch is shown, it is understood that multiple switches may be affixed to the columns. Further, although each column is shown having its own set of limit switches, it is understood that the limit switches may be positioned on a single column, and the controller would use other position sensors to keep the second support 3000 and likewise the first supports in the proper position.

Load sensor interfaces 2002 may read strain gauges to determine the load on individual columns. It is also understood that sensor interface 2028 can include an electrical load sensor that can be used to determine the load on each column. Other types of load sensors may be used, for example, hydraulic load cells, pneumatic load cells, pressure sensors and others. Strain gauges may be arranged in what is commonly referred to as a Wheatstone bridge configuration. These strain gauges are then coupled to a transducer or other device that produces a signal indicative of the load. The signal is transmitted to the controller 4000 for analysis and calculation.

The controller 4000 is shown with a display 4400, a processor 4100 and controls 4500, 4502, 4504. The joy stick 4500 may be used to move the second support 3000 up and down. As shown, there are four joy sticks, which may be independently linked to the columns to allow for manual control. As an example, manipulation of a single joy stick may cause all four columns to change position in response to the control input. The control program that executes on the processor 4100 will receive the control input that may be indicative of a position change or a desired position. The control program would then calculate a control signal that would be transmitted to the columns 2000, 2100, 2200, 2300 to change the position of the columns while monitoring the position and load sensors.

Button 4502 may indicate a pre-determined position that is designated by the intermediate limit switch 2016 or the top 2006 and bottom 2008 limit switches. The key board 4504 may be used to select or input certain desired positions or to indicate various control functions. The controller may provide a graphic user interface that can be used in conjunction with a mouse (not shown). The display 4400 may also be a touch sensitive display that receives user input for the control of the positioning device.

Figure 2:
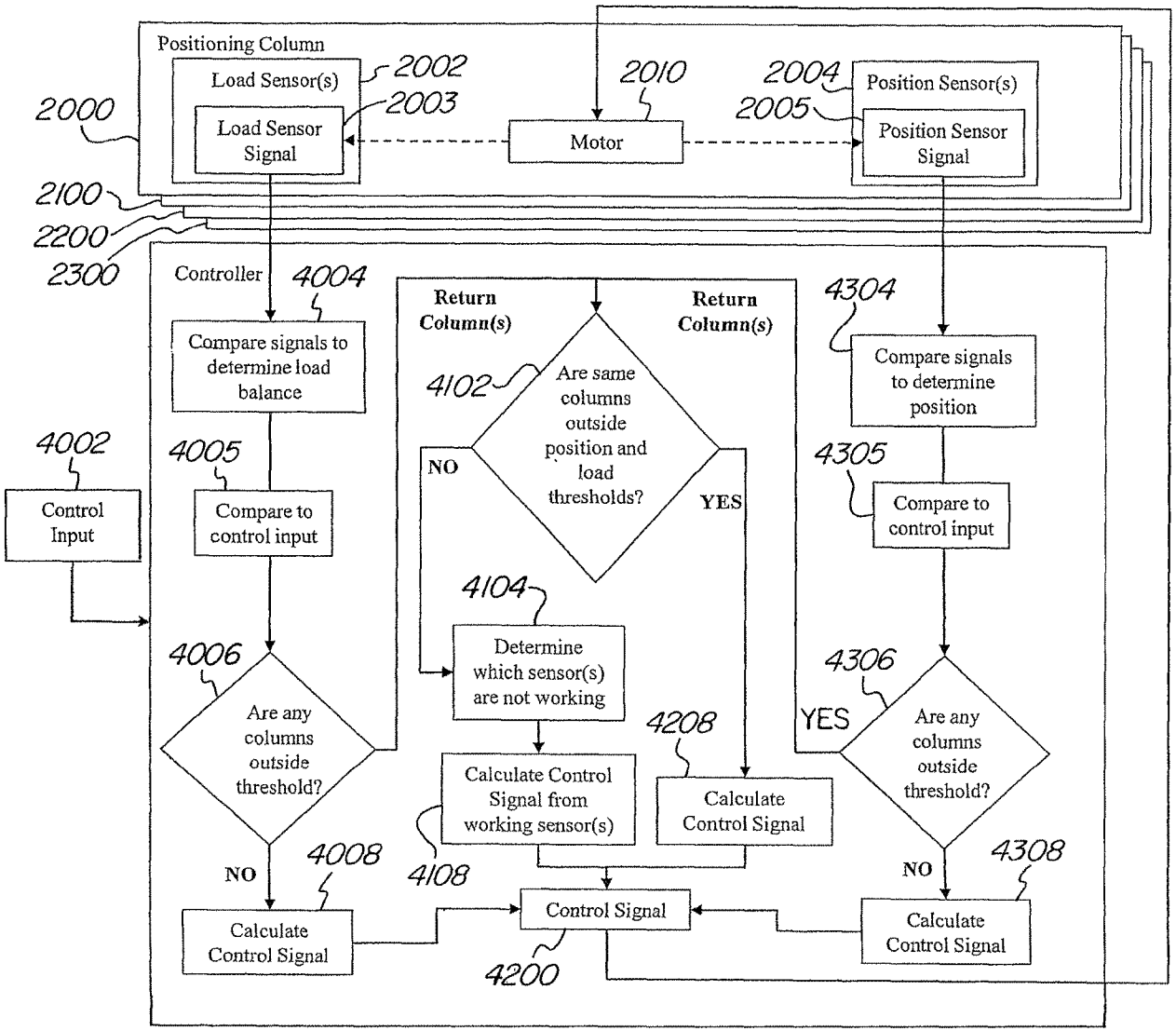
FIG. 2 is a schematic representation of the system of FIG. 1.

In FIG. 2, the positioning column 2000 includes a motor 2010 and a load sensor 2002 and position sensor 2004 that may or may not be connected to the motor. The load and position sensors may be connected in other places on the positioning column, for example, the screw 2040, the first support 2010 or other locations. The load sensor transmits a load signal 2003 to the controller and the position sensor sends a position signal 2005 to the controller. Therefore, if there are four columns, each column sends a load signal and a position signal. The four position signals are compared by the controller to determine the position of each column, or to determine the position of each column relative to a reference. Likewise, the four load signals in this example are compared to determine the load balance or the deviation of certain columns from a reference. For example, if the average load on the columns is 5 tons, this could be the reference. If a particular column has a load of 4.9 tons, his could indicate that the load is off balance or that the position of one or multiple columns needs to be adjusted to balance the load.

The calculated positions and the calculated loads can be compared to a threshold. This threshold is an acceptable range or percentage that is built into the control program. For example, if the difference in position is within ¼ of an inch, adjustment may not be necessary. Further, since the system may be moving in response to a control input, it is expected that certain variances may be tolerated. The example of a ¼ inch above is exemplary only and not limiting.

The same threshold holds true for a load signal. The controller compares the positions 4304 and then determines if any columns are outside the threshold 4306. If the calculated or measured loads are within a certain percentage of the average, for example 5%, adjustment may not be necessary. Therefore, in the case where the sensor readings indicate that the columns are within the desired thresholds or tolerances that are acceptable for the correct movement and control of the apparatus, the control signal 4200 could be generated and sent to the motors 2010, 2110, 2210, 2310 to continue moving the first supports and likewise the second support 3000 towards the desired location according to the control input 4002.

It is also possible that if a load signal indicates a load outside the threshold, the position could indicate that the second support 3000 is level. For example, if columns 2000 and 2300 both shown a higher load, the item on the second support 3000 may be off center, thus causing the discrepancy. However, if a single column is outside the load threshold, it would be more likely that that column needs to be adjusted, thus the controller could calculate the control signal to balance the load more evenly across the four columns. If columns 2000 and 2100 are both out of the load threshold, this could indicate that the corresponding side of the positioning apparatus needs adjustment. However, if the position sensors indicate that the second support 3000 is level, the off balance load may be due to the load on the second support being off center, thus not requiring adjustment to the columns to level the second support 3000.

The control input 4002 may be indicative of a specific position. The control input may also indicate an up or down command. For example, if joystick 4500 is pressed forward, the associated control input would indicate that the operator wishes to move the second support 3000 upwards. The control input may also have a speed indicator. For example, pressing the joystick 4500 all the way forward would indicate a higher speed than pressing the joystick halfway forward between the neutral and maximum positions of the joystick. As discussed above, the keyboard 4504, buttons 4502 or display 4400 can receive control inputs. These inputs may be associated with particular pre-programmed positions. The pre-programmed positions may, for example, be associated with intermediate limit switches 2016 or with particular linear position indicators or measurements.

Balancing the load may require moving the object that is resting on the second support. In this case, the control program would ensure that pairs of columns are balanced according to pre-determined parameters. For example, columns 2000 and 2300 may be linked as a balanced pair and columns 2100 and 2200 could likewise be linked as a balanced pair. Therefore, the average load between the four columns may be 5 tons, with Columns 2000 and 2300 each having 4.9 tons and columns 2100 and 2200 having 5.1 tons. Before transmitting a control signal, the controller would also verify the position of each of the columns. If all columns are in a level position, the control signal would not try to balance the load for an evenly distributed 5 tons across all four columns. This is because the likely cause of the unbalanced load is that the item sitting on top of the track sections 3100 is not centered. If the position signals indicate that the second support is level, adjusting the columns to balance the load may result in the item on the top of the track moving or rolling due to a non-level surface.

In order to avoid abrupt starts and stops when moving the first supports, the controller may calculate the control signal to slow down movement of the first support(s) 2010,2110, 2210,2310 as the desired position approaches. Likewise, the initial movement of the motor from a rest position would slowly accelerate the screw. As an example, upon receiving the control input, the control signal would be calculated by comparison of the positions and loads to verify that the first supports and likewise the second support is starting from a level position. The load on the columns may impact how quickly a load can be sped or up or how long it takes to slow movement. Based on the position and load sensors, the controller can generate the control signal on a case by case basis based on the load on the columns.

If the initial position is not level, the controller would adjust the columns on an individual basis to achieve a position that is level within the position thresholds that may be either selected or built into the system. This may be considered a calibration procedure that verifies the starting point of a lifting or positioning operation. The load may be off center in relation to the second support as previously discussed, thus once an initial and level position is determined, the load balance would be built into the expected movement and load thresholds for each column.

The initial calibration of the load balance may be done in relation to a known position. For example, when the track is lifted to the top position 3020, the limit switches of each column 2006, 2106, 2206, 2306 may be activated on each column to indicate the upper position. Since the limit switches are in a position that is known to be level, the position sensors and the load sensors can be calibrated with the known level position. Thus, when the portion of the vehicle is placed on the track section 3100, the calibration can assume a level position according to the limit switches. Upon receiving the control input to move from the top position 3020 to the bottom position 3010, the system could calibrate the position sensors or determine the load balance or both. The load balance may be used in setting the load threshold, which is a range of load values or percentage deviation that are considered acceptable tolerances during movement. The same calibration can be done with intermediate switches that have been previously discussed herein.

In the case where the load sensor is an electrical load sensor, the calibration may be partially based on previous lifting operations. This calibration may be stored with the motor or the controller. If the controller stores a motor specific calibration, the motor may have an identifier that is read by the controller to associate a connected motor with a calibration. The calibration may be necessary due to manufacturing tolerances and efficiency discrepancies between the various motors. For example, one motor may be slightly more efficient than the other three, thus would have a reduced electrical load for the same mechanical load exerted on the first support. Therefore, when the second support is being moved in a level orientation, the electrical load may be expected to be different for each motor. There may be more than one load threshold associated with the motors. One threshold may be based on specific calibrations for each motor, and another threshold may be based on the range of efficiencies commonly seen in the particular type of motor. For example, the motors may have factory calibrated ranges of efficiency and torques that are expected and verified for a motor of a given size. A motor falling outside the factory calibrated efficiency ranges could indicate that the motor is in need of repair. Thus the controller can verify the expected ranges of performances of the motors and can likewise produce a signal for display on the controller, where the signal can indicate which motor needs repair.

When calculating the control signal, there could be a speed associated with the rotation of the motors. As previously discussed, the position sensors may be a rotational encoder that counts the number of rotations of the motor or screw. Based on gearing and the pitch of the screw threads, the position of the first support can be calculated using time and number of rotations. Alternately, the position sensor can be a linear or true position sensor that measures the position relative to the columns, for example the optical sensor 2004 and the position strip 2014 previously discussed. Numerous types of linear position sensors can be interchanged with the optical sensor 2004 as would be apparent to one of skill in the art.

The controller could have a desired motor speed that would equate over time to desired positions. Upon transmitting the control signal to the motor(s), the controller can verify that the motors and the first supports are moving according to expected calculations. At the same time, it is possible that the position sensor could miss a rotation or a marking and thus begin reading incorrect positions. Since the load balance was done initially, if one sensor fails, the other sensors can be used to verify that the second support is maintained at a level position during the positioning operation.

Figure 3:
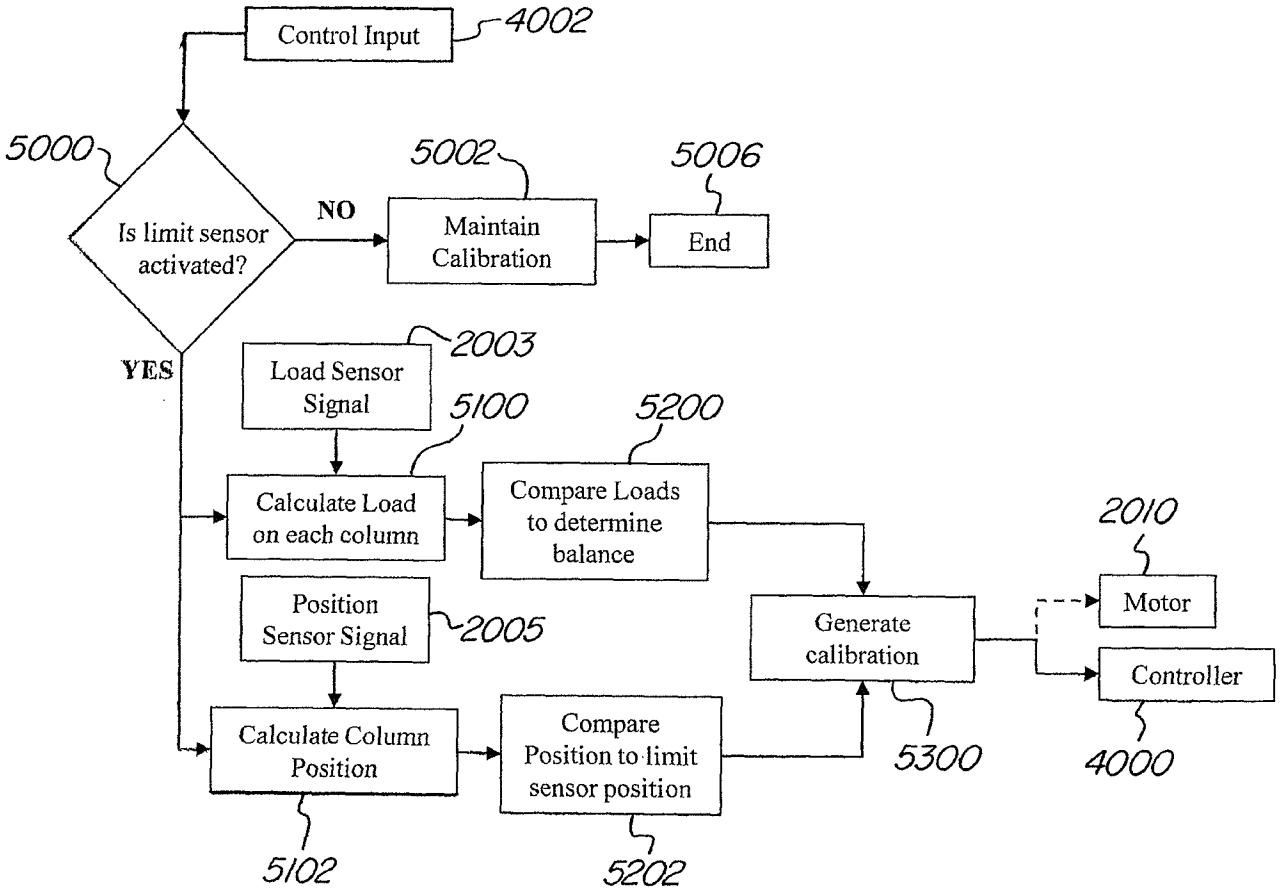
FIG. 3 is a schematic representation of how loads and positions may be compared according to FIG. 2.

In FIG. 3 a schematic shows the calculation of the calibration based on the activation of the limit sensors. In order to begin the calibration routine, a control input 4002 may have been received to move the second support 3000 away from the position associated with the limit switch. Alternately, upon reaching a limit switch or intermediate limit switch, the position and load signals at the time the limit switch or intermediate switch was activated can be used for purposes of calibration. Depending on the sensors used, an electrical load sensor may not show any load when the first supports are stationary. In this case, the calibration may only impact the position sensor. Although, once movement has begun, the load sensors may be re-calibrated shortly after movement commences under the assumption that the position of the first supports after a small movement will remain in an appropriate position. If the limit sensor is not activated, the original calibration can be maintained 5002, as discussed previously, if the limit switch was recently de-activated, it may be appropriate to re-calibrate or verify the calibration of the load sensors. When calibration is to occur, the load is calculated on each column 5100 using the load sensor signal 2003. The position of each column is calculated 5102 using the position sensor signal 2005. The loads of each column are compared 5200 to determine load balance and the calculated position of each column is compared to the known limit sensor position 5200. Using these comparisons 5200, 5202, a calibration is generated 5300. This calibration is then used by the controller 4000. In some cases, the motor may store the calibration 2010 if the apparatus is to be used with a different controller. This would allow a positioning base with columns to move along the factory to a different location using the wheels 1100, 1110 as previously described. At the different or second location, the apparatus can then be connected to a controller and the calibration that was sent to the motor can be read in order to re-use the previously calculated calibration. It is also contemplated that the calibration routine can be done based on a user input to the controller. Thus, if appropriate, the user could request a calibration once a load is placed on the second support, and the controller would run the calibration routine.

Figure 4:
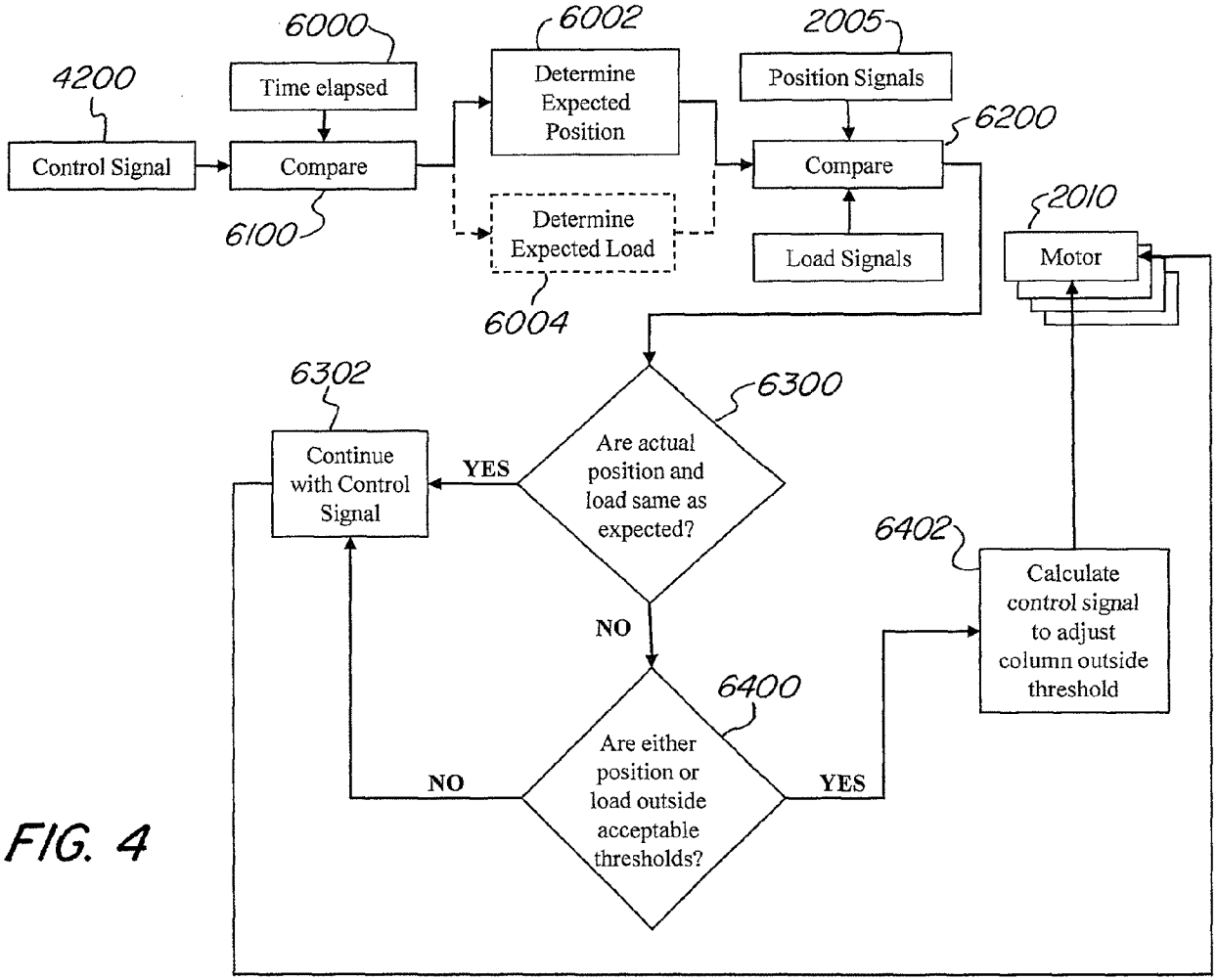
FIG. 4 is another schematic representation of how loads and positions may be compared according to FIG. 2.

In FIG. 4, when the control signal 4200 is transmitted, a corresponding movement and load could be expected to be read on the sensors. Based on the control signal 4200 and the elapsed time 6000 a comparison 6100 can determine the expected position 6002 and/or the expected load 6004. The expected load and or positions are compared 6200 to the position signals 2005 and the load signals 2003. If the actual positions and/or loads are the same as expected 6300, the system continues with the control signal 6302 and the associated parameters. The control signal in this case would continue to cause the motor to rotate according to the parameters that were calculated based on the control input. These parameters may include gradual speeding and slowing of the rotation at the ends of the movement cycle, and may include pre-determined positions. If the loads or positions are not the same as expected, the system compares the loads and positions to thresholds 6400. If the loads are outside acceptable thresholds, the control signal may require adjustment or re-calculation for one or multiple motors or columns 6402. In this case, the adjusted control signal is sent to the motor(s) in order to keep the first supports and likewise the second support level. The thresholds may be calculated in part based on the calibration referenced in FIG. 3. If a load is off balance or off center of the second support, the positions of the columns would be expected to be equal, but the loads would not. Typically, the discrepancy of the loads would be associated with pairs of columns. For example, it would be expected that loads on columns 2000 and 2300 would be similar or the same (within a first threshold), and the loads on columns 2100 and 2200 would be the same (within a second threshold). The ranges of the first and second thresholds may be the same size in terms of load. For example a range of 200 lbs could be associated with the threshold where the difference between columns 2000 and 2300 should be less than 200 lbs in order to be within the threshold, assuming the load is off center and two thresholds are used in order to maintain a level second support 3000. Similar ranges based on amperage or wattage may be associated with electrical load sensors if used.

Figure 5:
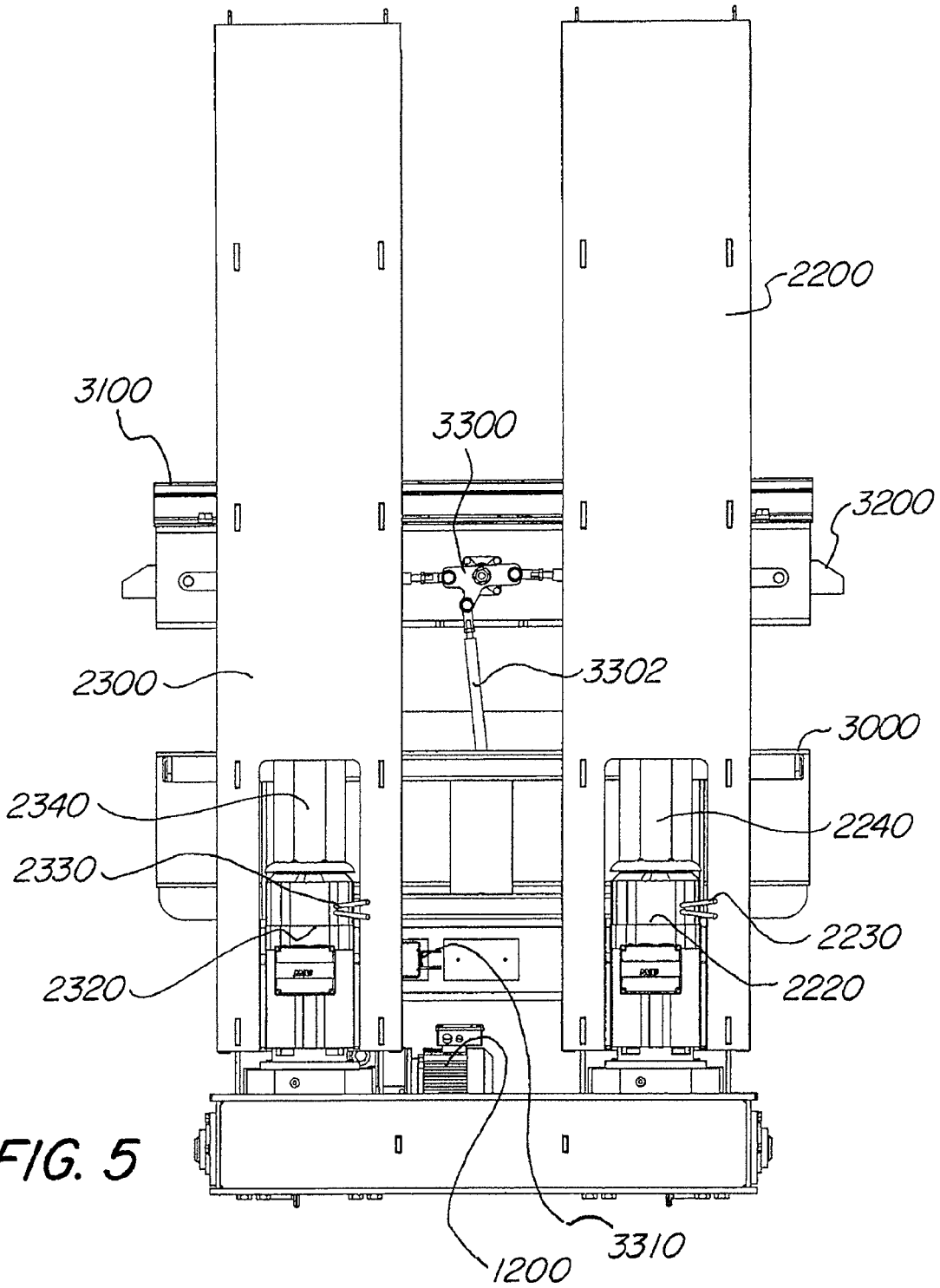
FIG. 5 is a side view of part of the lifting and positioning apparatus of FIG. 1.

In FIG. 5, motor 1200 may be connected to the wheels 1110. It is understood that there may be a motor for each set of wheels 1100, 1100 or a single motor coupled to the front and back wheels. It is further understood that one or both sets of wheels may rotate about an axis orthogonal to their axles in order to steer the positioning apparatus 2. Also shown is an actuator 3310, which may, for example be a solenoid, motor or a pneumatic or hydraulic cylinder. It is understood that other types of actuators may be used to manipulate the linkage 3300. The actuator 3310 is used to extend and retract the catches 3200. A downward force on bar 3302 could extend the catches, whereas an upward force would retract the catches 3200, both actions causing a rotational force or torque on linkage 3300. The screws 2240,2340 can be rotated by the motors 2220,2320 in response to control signals from the controller.

Figure 6:
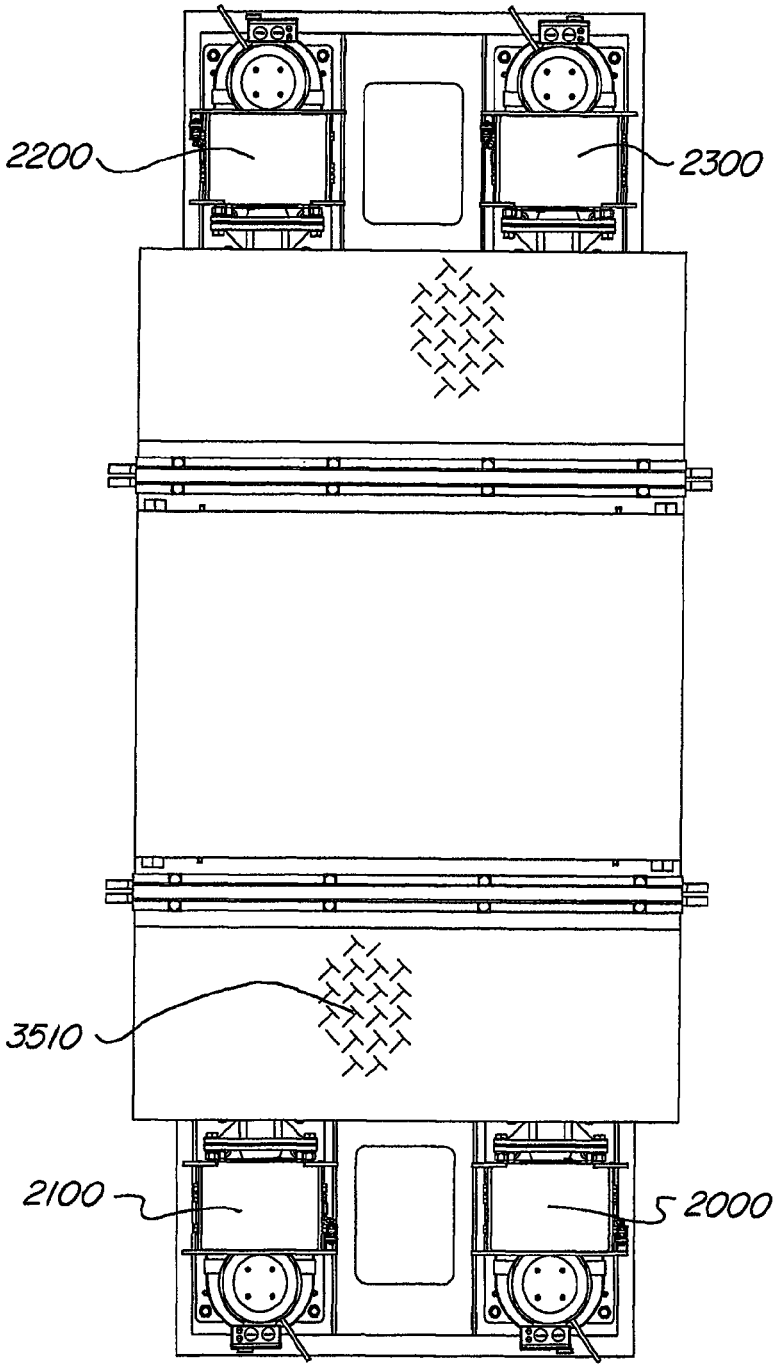
FIG. 6 is a top view of the part of the lifting and positioning apparatus of FIG. 1.

In FIG. 6 the surface of the second support 3000 may include texture 3510 to provide additional traction for repair or factory personnel. It is understood that the texture may exist on both the upper 3500 and lower 3400 levels of the second support.

Figure 7:
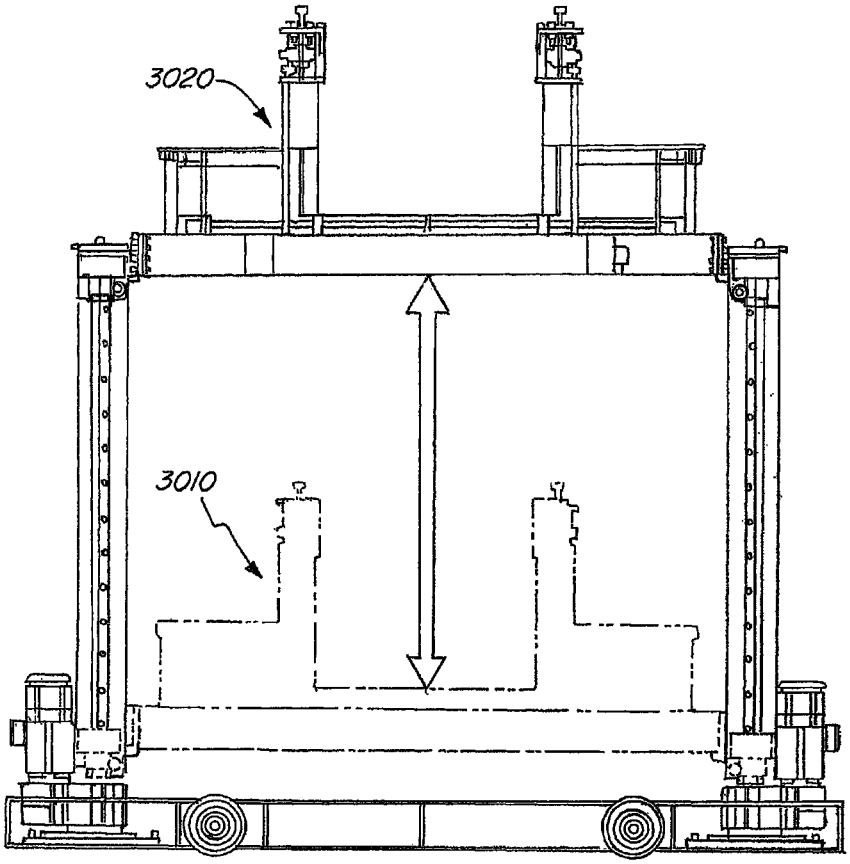
FIG. 7 is a side view showing various positions of the lifting and positioning apparatus of FIG. 1.
Figure 8:
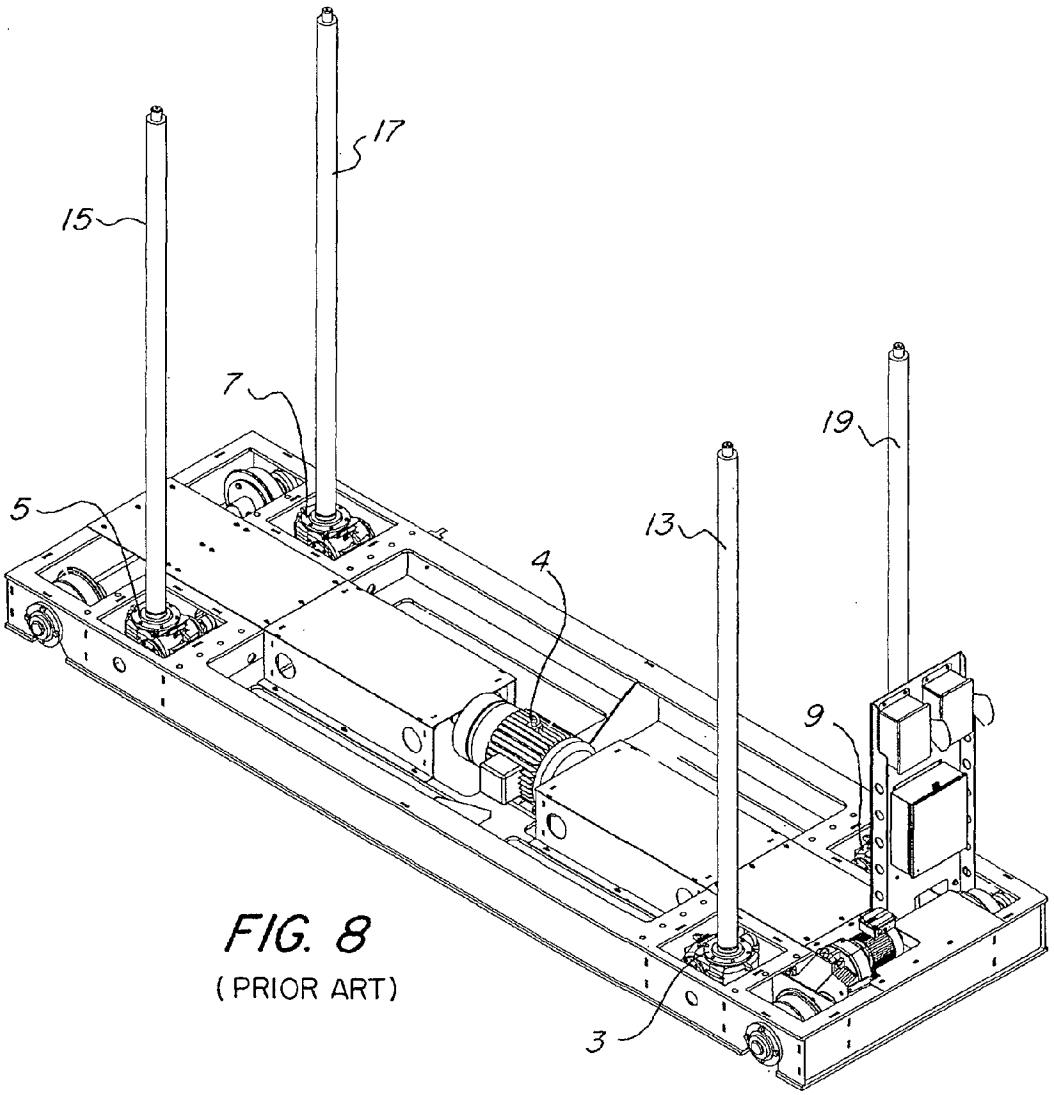
FIG. 8 (PRIOR ART)
FIGS. 8 and 9 show a prior art lifting and positioning apparatus.
Figure 9:
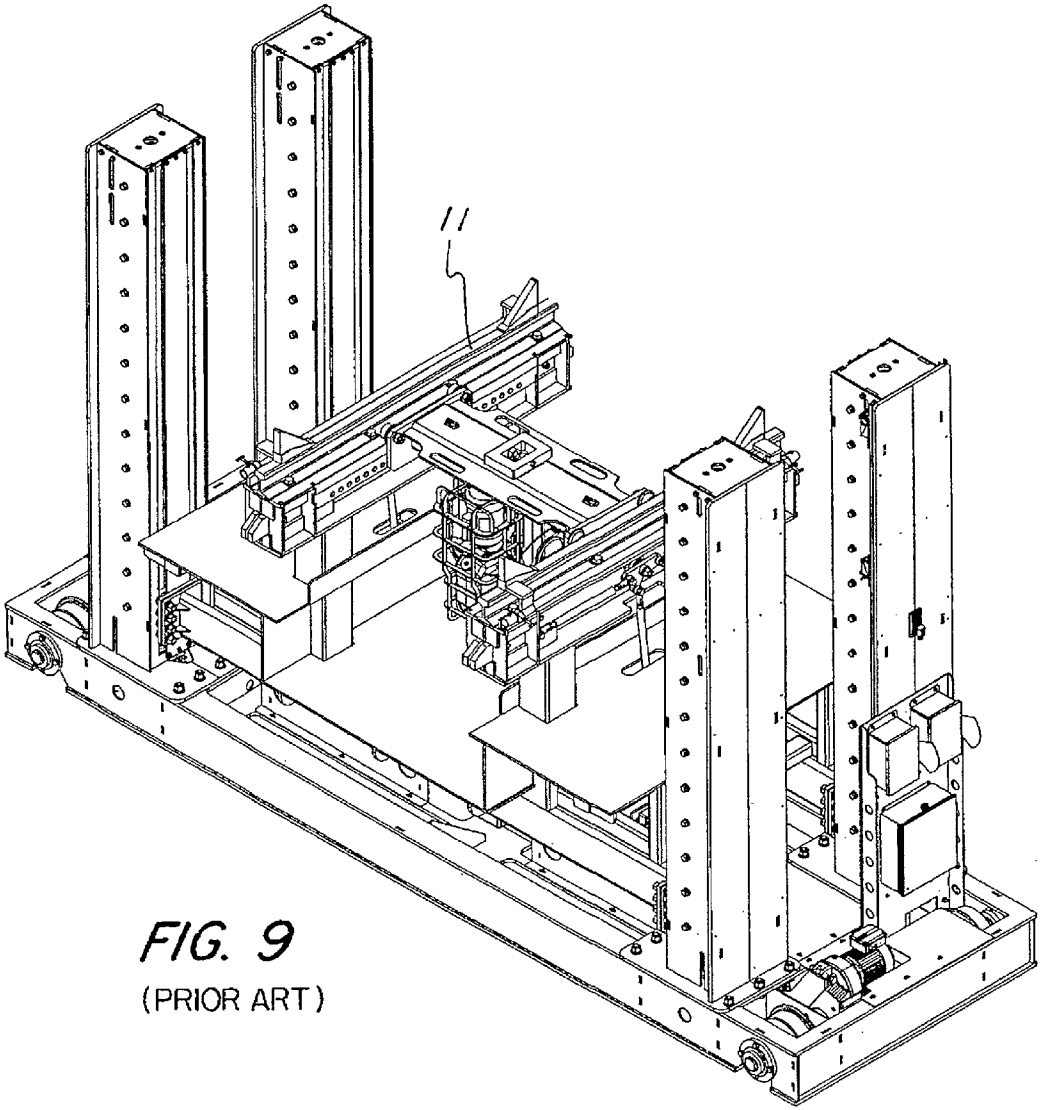
FIG. 9 (PRIOR ART)
Figure 11:
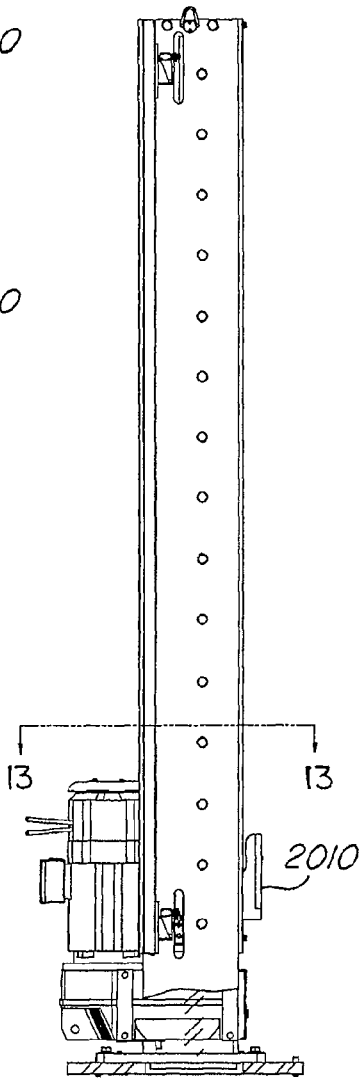
FIGS. 11 and 12 show side and perspective views of a positioning column of FIG. 1.
Figure 12:
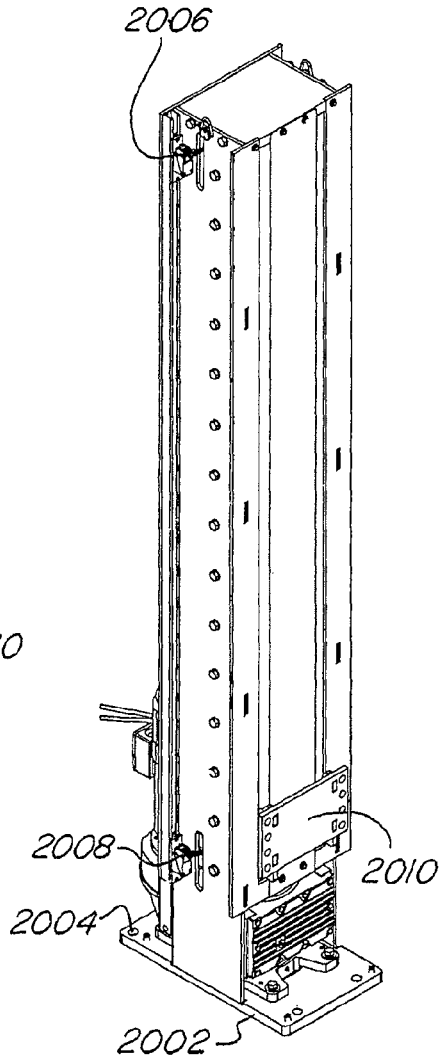

FIG. 7 shows top 3020 and bottom 3010 limits of the second support 3000. The top and bottom limits may be monitored using limit switches 2006, 2008 as shown in FIGS. 11 and 12. The limit switches 2006, 2008 are in communication with the motor and/or the controller. For example, the limit switches may send a signal to the motor or the controller to stop the first supports from moving. For example, if the second support is in the top position 3020 and the motors continued to rotate, the female threaded sections of the first supports could become un-connected to the screw, thus causing placing a potentially heavy load in a precarious position. The use of the limit switches can prevent the motor from rotating the first support off of the screws. It is also contemplated that the positioning of the limit switches 2006,2008 can be adjustable based on common positions that are expected to be used with the positioning apparatus 2. It is also contemplated that intermediate switches may be placed along the column, for example between switches 2006 and 2008. The intermediate switch could likewise be set up to provide an intermediate stopping point that is commonly used in a given application. The intermediate switch could be associated with different logic and or electric controls than the limit switches. For example, the limit switches may be common positions, but these switches also provide a safety stop that prevents the first support and the screw from becoming uncoupled. The intermediate switch simply provides a signal that indicates to the motor and/or the control program that the second support 3000 has reached a pre-configured position.

It is also contemplated that the limit switches can be directly linked to the power supply to the motor. Thus, when the limit switch is reached, the power to the motor stops for the particular column. If one column stops, the controller would then limit the movement of the other columns to a pre-determined range. For example, in case a limit switch is not working properly, movement of one column could be stopped, allowing the other columns to continue movement could damage the machinery.

It is also contemplated that the controller will allow for operator overrides for a number of the positioning routines that would allow the load to be moved under a manual operation that allows for manual control of the columns on an independent basis.

Figure 10:
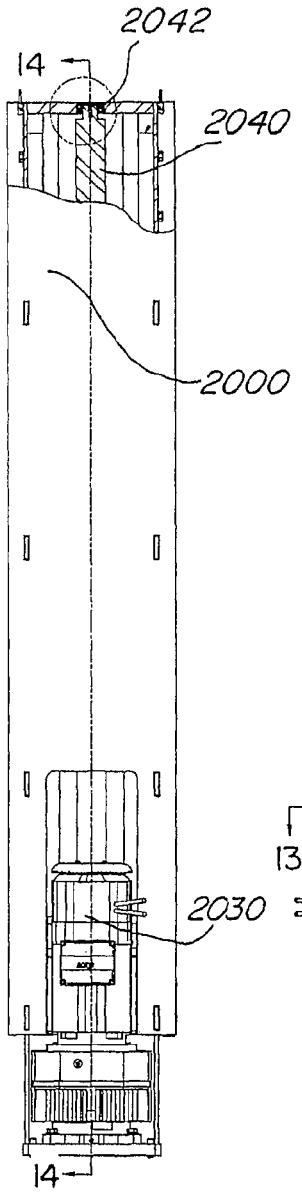
FIG. 10 is a partial cutaway rear view of a positioning column of FIG. 1.
Figure 14:
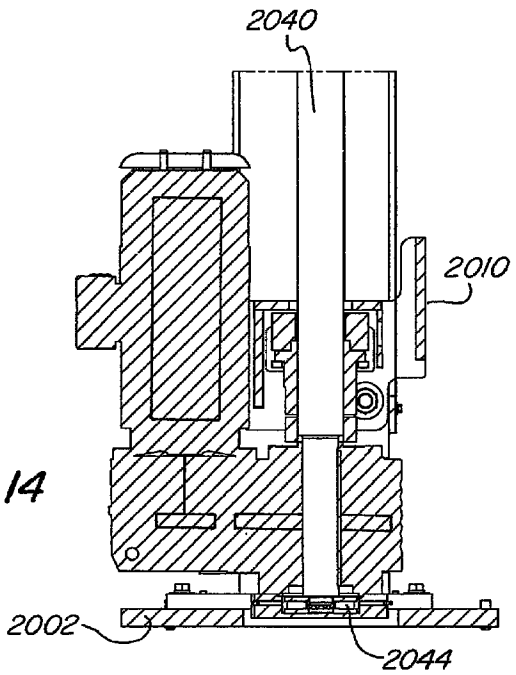
FIG. 14 is a section view of the positioning column of FIG. 10 shown along section line 12-12.
Figure 13:
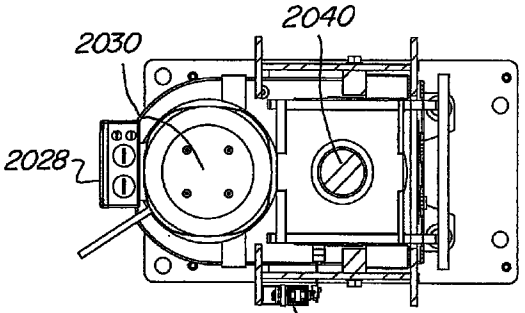
FIG. 13 is a section view of the positioning column of FIG. 11 shown along section line 13-13.

In FIG. 10, a partial cutaway shows screw 2040 and upper bearing 2042 of the column. In FIGS. 11 and 12, the bottom 2008 and top 2006 limit switches are shown. Flange 2004 is adapted to releasably secure to the base of the positioning apparatus, for example, with nuts and bolts. FIG. 13 shows the column along section line 13-13. The motor 2020, screw 2040 and bottom limit switch 2008 are likewise shown. In one embodiment a sensor interface 2028 is coupled to the motor. This sensor interface may include a rotational encoder that measures the position of the first support by counting the number of rotations of the screw. It is also understood that the sensor assembly 2028 can further include voltage and/or amperage sensors that can likewise detect the power drawn by each motor and thus determine the load on the columns. In FIG. 14, a cross section of the column is shown along section line 14-14. The bottom bearing 2044 is coupled to the screw 2040, and the first support 2010 can move up and down in response to rotation from the motor. The column has a flange at the bottom end that can connect to the base of the positioning apparatus. This flange can be releasably secured so that one column can be replaced with a replacement column with minimal downtime. The sensor and electrical connections of the new column can likewise connect to the controller with releasable connections so that the columns can be quickly connected and disconnected from the overall positioning apparatus system.

The control input may indicate a desired position that is associated with the intermediate switch. In this case, when the intermediate switch is activated, a signal is sent to stop the motor. It is understood that the signal can also cut power to the motor by opening the circuit. Although the intermediate and limit switches each provide a specific position, it is understood that other position and load sensors may be used in order to smoothly control the lifting and positioning of the load. For example, as the first or second supports approach a desired position, the controller could progressively slow the rotation of the motor so that the desired position is not passed and/or so that when the desired position is reached, there is not an abrupt halt to the lifting motion. The limit switches may prevent the motors from continuing to rotate and thus forcing the first support off the end of the screw.

Although some mechanical limit switches have been shown, it is also contemplated that optical sensors similar to the optical position sensors can be used as limit switches. For example, the optical sensor may send a light wave towards a reflector, and when the first support or another object is placed between the light and the reflector, the optical limit switch would transmit a signal to the controller that indicates the first support has reached the position of the limit switch. The limit switch may be associated with a logic in the controller or overall system that is a on or off operation. For example, when the limit switch is in the "on" position or operation, the first supports will move. When the limit switch is in the "off" position or operation, the controller or overall system will know not to move the first support past the position of the limit switch. For example, the top limit switch would reduce the likelihood that the first support would be moved to a point where it came off the screw at the top position.

When the sensors are indicative of a position of the first support they are likewise indicative of a position of the second support, because the first and second supports are connected. For example, if there are four sensor signals that each indicate the position of one of the first supports, the sensors both collectively and individually would indicate a position of the second support. As a further example, first support 2010 as shown is connected to the second support 3400 at an interface that uses a number of nuts and bolts. Thus, a signal indicating the position of the first support would indicate that one corner or location of the second support is in the same position. At the same time, each signal indicative of the position of one of the other first supports could indicate that different locations on the second support are in a different vertical position or a different position relative to a reference.

Figure 15:
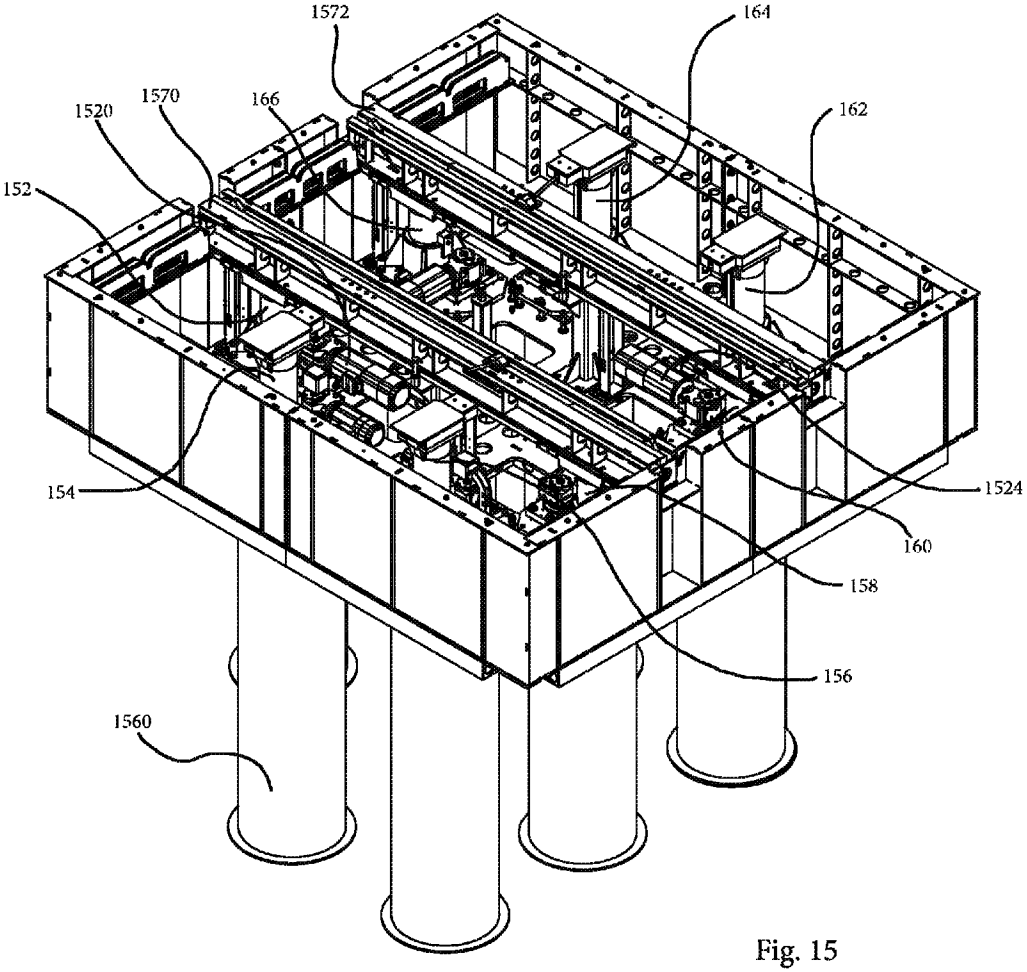
FIG. 15 shows perspective view of an alternate positioning apparatus having independent drive columns similar to FIG. 1.
Figure 16:
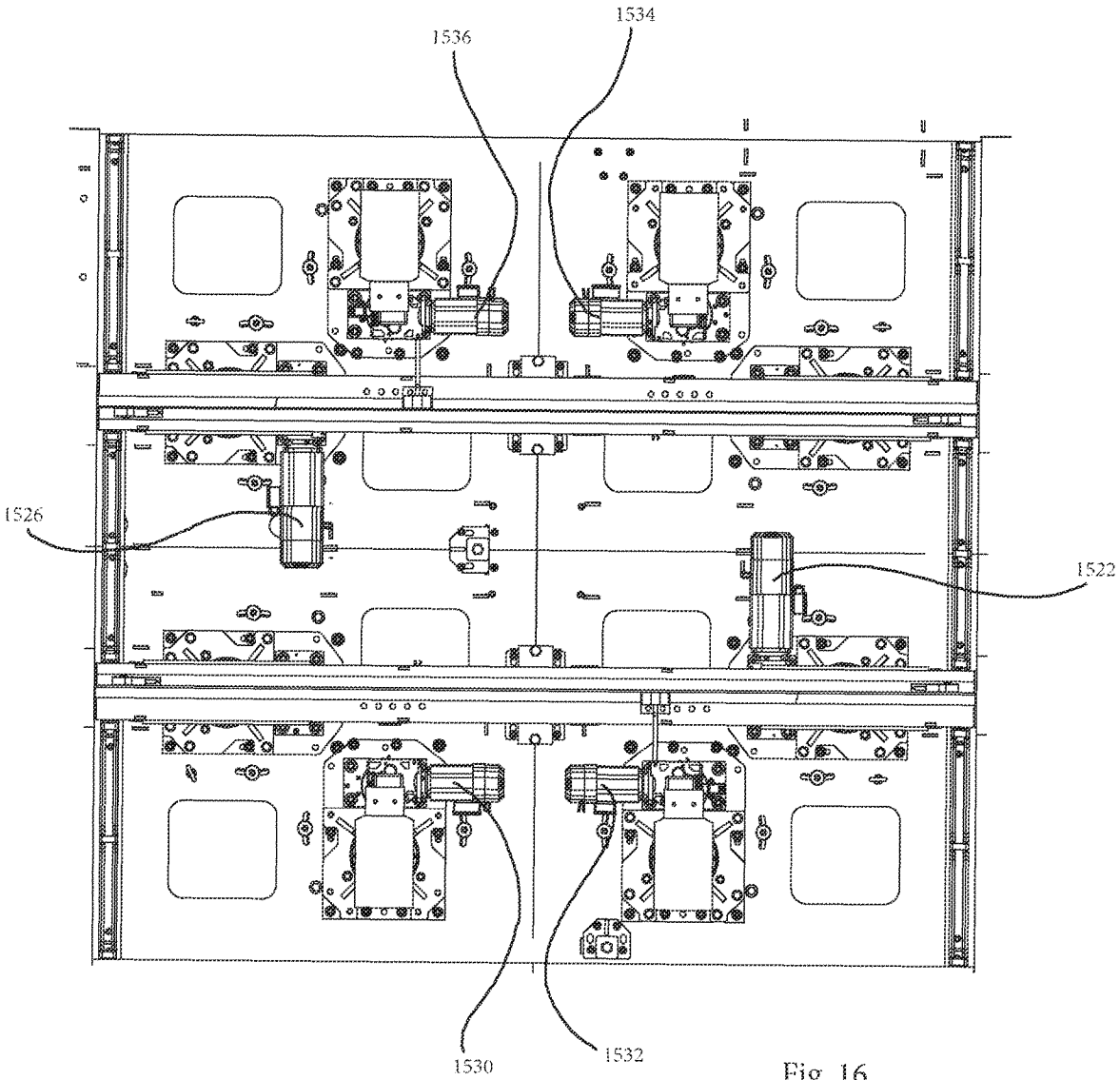
FIG. 16 shows a top view of the apparatus of FIG. 15.

In FIG. 15, an example of a vehicle repair hoist such as a rail car hoist is shown. The machinery has 8 columns, 152, 154, 156, 158, 160, 162, 164, 166. Each column has a motor that is connectable to a controller, for example a controller similar to that shown in FIG. 1. Columns 152 and 158 are connected to support 1570. Columns 160 and 166 are connected to support 1572. The controller is receives sensor readings from each of the columns and generates control signals in response to a control input to move supports 1570 and 1572 up and down while maintaining proper load balancing and level positioning. Secondary columns 154, 156, 162 and 164 are coupled to motors 1530, 1532, 1534 and 1536. These secondary columns may interact with a body of a rail car or locomotive to provide additional support or to separate the car body from the wheel assembly, depending on the repair desired. Although it is presently shown that no mechanical link connects the top of the columns, it is contemplated that a support such as an "I" beam could be used across the top end of the secondary columns and bolted or otherwise affixed to the columns.

The controller can be designed to generate control signals in response to a control input indicative of a movement of the secondary columns. The movement of the secondary columns may be independent or linked to the movement of columns 152, 158, 160 and 166, depending on the item to be lifted and the control input received. In the case where all 8 columns are desired to move together, the controller would receive the control input and may determine that the secondary columns are not supporting any load. In order to balance the load properly, the secondary columns may first be moved into contact with the rail car (resulting in a load on the secondary columns). The controller may also generate a control signal that is offset relative to the columns controlling supports 1570 and 1572 based on the load limits or desired loads on particular columns. For example, the offset may reduce the load on the secondary columns by 50% because the body of the rail car being lifted may not be designed or intended to support the load of the wheel assembly. The 50% figure provided above is exemplary only and not limiting. As one of skill in the art would understand, different load balances may be required or desired depending on the item lifted and the repair or assembly job to be completed. Further the secondary columns may support all or a higher percentage of the load, depending on the application.

Figure 17C:
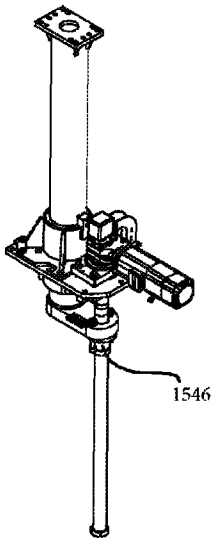
FIGS. 17A-17C show front, side and perspective views of a column of FIG. 15.
Figure 17B:
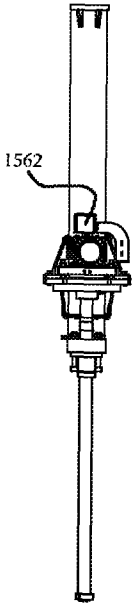
Figure 17A:
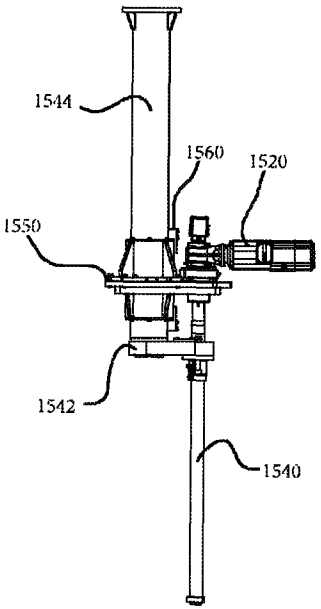

In FIGS. 17A-C, some of the features of the individual columns of the apparatus in FIG. 15 is are shown. Like the lifting apparatus of FIG. 1, the replacement of the individual columns simply requires unbolting the column from the foundation. For example, the flange 1550 can have a pattern of holes for bolts that affix the column to the foundation. A screw 1540 is driven by motor 1520. A support 1542 is connected to the bottom of support 1544. When the motor turns, threaded portion 1546 moves up and down along the axis of the screw, thus causing support 1544 to move up and down along its axis. Sensor interfaces 1560 and 1562 are connectable to the controller similar to that shown in FIG. 1. These sensors are used within the control program as previously described to move the columns in groups or individually, depending on the control parameters. Typically columns will move at least two at a time, to maintain the item to be lifted in a level plane, however it is also contemplated that certain operations could require that the columns move individually. Since each column is independently driven by a motor, the control program and positioning operations can be modified and programmed without use of transmissions to move individual columns.

Figure 18:
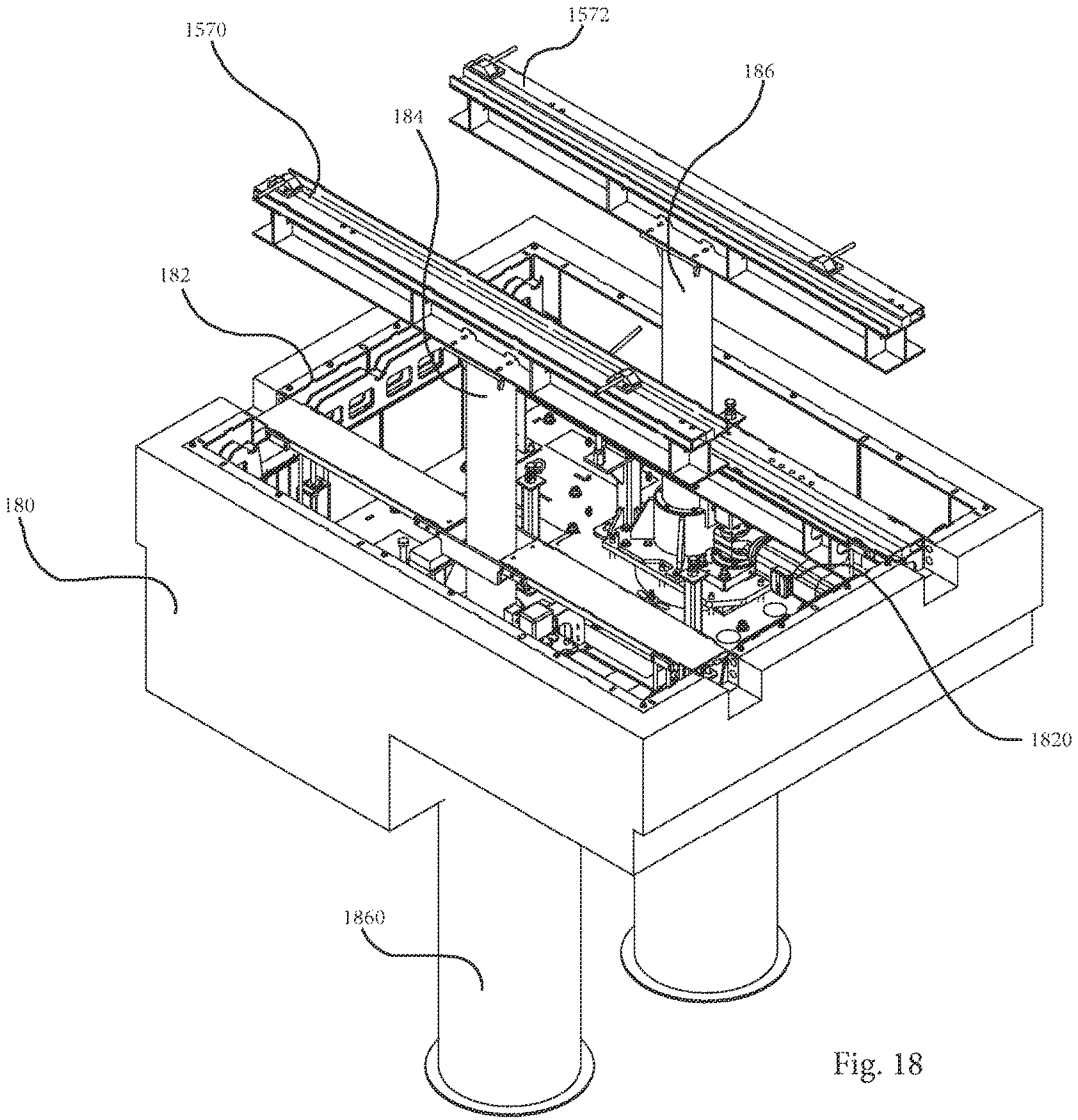
FIG. 18 shows a perspective view of an alternate positioning apparatus having independent drive columns similar to FIGS. 1 and 15.

In FIG. 18, a wheel assembly hoist is shown installed in a foundation 180 using a foundation frame 182 that defines the walls and opening of the foundation. The wheel assembly hoist may also be referred to as a truck hoist. The machinery installed in the foundation is designed to operate within the opening. Each column 184, 186 is connected to a support 1570, 1572 that may have rails for a wheel assembly from a rail car. The columns are each driven by a motor similar. For example column 186 is driven by motor 1820. The motor for column 184 is obscured in the drawing, but is present in the machinery in order to move the column 184. Below the foundation 180 there are pit members 1860 that extend into a hole or pit below the foundation. This may be a cylindrical steel tube that is bolted, welded or otherwise attached to the underside of the foundation frame 182. The pit members 1860 contain the screw 1540 and other parts of the column assembly. Since support 1544 moves up and down both above and below the base level of the frame 182, the pit members 1860 can be disposed around the outside of the screw 1540 and support 1544. A back fill material such as gravel may be disposed around the outside of the pit members. Foundation frame 182 has attachment locations that receive bolts for affixing the columns to the foundation. Also, a machinery hole (not shown) in the foundation frame is disposed such that the support 1544 can move with the machinery hole.

It is also understood that the columns and the machinery shown in FIGS. 15-18 can include limit switches and intermediate limit switches to help with proper positioning and operation of the control program. It is also understood that the motors and drive systems associated with the motors can have a locking feature that prevents the load on the columns from unintentionally causing the apparatus to move downwards due to the screws turning unintentionally. This locking feature may be activated and de-activated with the controller and may also be accomplished automatically when movement stops. The locking feature may be designed to lock when power is removed from the motor as an added safety feature.

Although the invention has been described with reference to a particular arrangement of parts, features and the like, these are not intended to exhaust all possible arrangements or features, and indeed many modifications and variations will be ascertainable to those of skill in the art.

What is claimed is:

1. A positioning apparatus for a vehicle or portion thereof comprising:

a plurality of columns each having a first support and a motor adapted to move the first support along an axis of the column;

a second support connected to at least two of the first supports;

a track member connected to said second support, said track member for receiving at least a portion of a vehicle;

at least one load sensor transmitting a load signal indicative of a load on said plurality of columns;

at least one position sensor transmitting a position signal indicative of a position of said first supports; and a controller in communication with the plurality of columns and receiving the load and position signals, the controller comparing the load and position signals to generate at least one control signal;

wherein the at least one control signal is sent to at least one of said motors for controlling the position of at least one of said first supports.

2. The apparatus of claim 1 wherein at least one load sensor is connected to each of said plurality of columns and at least one position sensor is connected to each said first supports.

3. The apparatus of claim 1 wherein said load sensor is an electrical load sensor and said load signal is indicative of an electrical current of said motor.

4. The apparatus of claim 1 wherein said plurality of columns comprises at least three columns, the apparatus further comprising:

at least one limit switch connected to at least one of said plurality of columns at a bottom or top end, each limit switch having a first position and a second position;

wherein each limit switch is adapted to move from the first to the second position when one of the first supports is in a position associated with the limit switch.

5. The apparatus of claim 4 wherein when one said limit switches is in a second position, movement, of the first support corresponding to the column having the limit switch in the second position, stops.

6. The apparatus of claim 5 further comprising a third limit switch having first and second positions and coupled to at least one of the columns and disposed between first and second limit switches, the third limit switch in communication with said controller;

wherein a control input is indicative of a position associated with the third limit switch;

wherein the controller calculates a control signal from the position signal, load signal and control input to move the first support to the position associated with the third limit switch; and wherein movement of at least one of the first supports stops when the third limit switch is in the second position.

7. The apparatus of claim 6 wherein each column includes first, second and third limit switches.

8. The apparatus of claim 1 wherein said position sensor is a linear position sensor coupled to said first support and said position signal is indicative of a position of said first support in relation to a fixed point.

9. The apparatus of claim 1 further comprising:

a first and second limit switch coupled to at least one said plurality of columns, said first and second limit switches respectively positioned at top and bottom ends of said column, each limit switch having first and second positions;

wherein the motor is adapted to stop once one of the top or the bottom limit switches is in the second position, where the second position of one of the top and bottom limit switches indicates that the first support has reached the position associated with the top or the bottom limit switch.

10. The apparatus of claim 1 further comprising:

a control input received by said controller, the control input indicative of a direction of movement for the second support;

said controller calculating a load distribution among the first supports to generate a calibration for the controller, wherein the load distribution is maintained during movement of the second support.

11. The apparatus of claim 10 wherein the load distribution is maintained within a range of loads.

12. The apparatus of claim 1 wherein the apparatus is a railway drop table, a railway car hoist or a railway truck hoist.

13. The apparatus of claim 1 further comprising:

at least one secondary column having a motor and two sensors coupled thereto, the motor for moving a first support along an axis;

wherein the controller receives signals from each of the two sensors and generates a secondary column control signal to control a position of the first support of the at least one secondary column.

14. The apparatus of claim 13 wherein the two sensor of the at least one secondary column include a load sensor and a position sensor and wherein the secondary column control signal is calculated so that a load on the at least one secondary column is within a threshold, the threshold associated with a load on said plurality of columns.

15. The apparatus of claim 1 wherein said plurality of columns include a flange to releasably secure the columns to a foundation.

16. The apparatus of claim 1 wherein the plurality of columns are affixed to a base below a floor level, the floor level being associated with the vehicle.

17. The apparatus of claim 16 wherein the base is a foundation.

18. The apparatus of claim 16 wherein the base is movable on wheels.

19. A positioning column having bottom and top ends, the positioning column for a positioning apparatus and comprising:

a first support and a motor, wherein the motor moves the first support along an axis of the column, said first support connects to a second support, wherein the second support is adapted to receive at least a portion of a vehicle, the second support connected to a second positioning column of the positioning apparatus;

a flange arranged at the bottom end of the column and the flange releasably secures to a base of the positioning apparatus;

at least two sensors coupled to the column and transmitting a signal to a controller having a processor with a control program executing thereon;

said motor receiving a control signal from the controller for changing a position of the first support in response to the control signal.

20. The device of claim 19 wherein the control signal is calculated by the controller in response to the signal received from said at least two sensors.

21. The device of claim 19 further comprising:

at least one limit switch connected to the column at the bottom or top end, the limit switch having a first position and a second position;

wherein each limit switch is adapted to move from the first to the second position when the first support is in a position associated with the limit switch.

22. The apparatus of claim 19 wherein a first one of said two sensors is an electrical load sensor and a load signal is indicative of an electrical current of said motor.

23. The apparatus of claim 19 wherein a first one said at least two sensors is a load sensor and a second one said at least two sensors is a position sensor.

* * * * *